United States Patent [19]

Sedberry

[11] 4,296,397

[45] Oct. 20, 1981

[54] FUSE STRUCTURE FOR CORROSIVE ATMOSPHERE

[75] Inventor: Donald C. Sedberry, Erdenheim, Pa.

[73] Assignee: Welsbach Ozone Systems Corporation, Philadelphia, Pa.

[21] Appl. No.: 155,799

[22] Filed: May 30, 1980

[51] Int. Cl.[3] ..... H01H 1/06

[52] U.S. Cl. ..... 337/199; 174/127; 337/224

[58] Field of Search ..... 335/199, 222, 224; 174/127

[56] References Cited

U.S. PATENT DOCUMENTS

| | | | |
|---|---|---|---|
| 1,930,804 | 10/1933 | Hart | 337/224 |
| 3,244,838 | 4/1966 | Astleford | 337/224 |
| 3,684,995 | 8/1972 | Horton | 337/199 X |

*Primary Examiner*—George Harris
*Attorney, Agent, or Firm*—John C. Dorfman

[57] ABSTRACT

A fine ozone corrosion resistant fuse wire is supported between conductive terminals which are, in turn, supported on and spaced apart by rigid insulator spacing means so that the fuse wire is extended. Insulator shield means is placed over the fuse wire over a substantial length of the insulator spacing means to shield the insulator spacing means from vaporized filament material to ensure that in all possible fuse failure modes that the circuit is completely broken but including a portion is unshielded so that vaporized material will plate on to the insulator to permit quick detection of a failed fuse. The rigid insulator spacing means may take the form of a rod generally parallel to the fuse with the terminals as end caps fitting over the rod or it may take the form of a tubular member fitting around portions of the terminals and confining the fuse internally, preferably so that oxygen cannot readily reach the fuse when it is used in a concentrated oxygen atmosphere.

12 Claims, 6 Drawing Figures

FUSE STRUCTURE FOR CORROSIVE ATMOSPHERE

The present invention relates to a fuse for use in corrosive atmosphere applications and particularly with ozonators wherein the atmosphere may cause premature failure of the fuse wire. More specifically, the present invention relates to an improvement in fuses of the aforesaid type whereby when a fuse fails, its very failure cannot create an alternate conductive path whereby the circuit to be interrupted is, in fact, able to continue operation.

BACKGROUND OF THE INVENTION

Since the fuses of the present invention were developed for use with ozonators, some background regarding ozonators is of particular significance. Ozone is produced by passing air, oxygen, or a mixture of gases containing oxygen through an energy field called a "corona discharge". The corona discharge is generated by creating a voltage potential between a series of mediums of known dielectric constant, one of which is the gap through which the oxygen containing gas is passed. The voltages encountered in an ozonation are generally from 6 KV to 22 KV and the frequencies from 50 Hz to 10,000 Hz.

Ozonators are often constructed of a group of cells. Each cell has one or more electrodes bonded or otherwise secured to a dielectric, an air gap and a ground plane. The ground plane frequently serves as one surface of a heat exchanger since most of the energy passed through the corona discharge is converted to heat and must be dissipated through air to air, air to water, or air to other cooling medium heat exchangers.

Failure of a dielectric results in the rapid discharge of energy through the dielectric at the point of failure. Ozonator power supplies are generally provided with thermal and magnetic circuit breakers or other devices that trip when a dielectric failure occurs. Since ozonator dielectrics are connected in a parallel arrangement and each draws a fixed amount of current under normal operating conditions the greater the number of dielectrics, the higher the trip point current on the ozonator breaker, and the greater the total capacitance of the ozonator. Thus, as the size of the ozonator increases, the energy available for discharge through a failed dielectric increases, while the ability to detect a failed dielectric and quickly shutdown the system becomes more difficult.

Failure to either shut down the individual failed dielectric or the ozonator usually results in puncture of the ground plane at the point of dielectric failure. Since the ground plane is usually one surface of the heat exchanger used for cooling the unit, puncture of the ground plane causes the cooling medium to mix with the ozonized air or oxygen.

In generators using water for the cooling medium, water will enter the ozonation cells if the pressure in the water jacket is higher than the air pressure in the ozonation cell. In an oil cooled system, oil can enter the ozonation cell and, depending on the flamability of the oil, the feed gas, and the process application, fire and/or process contamination can result. In air cooled systems the pressure inside the ozonator cell is greater than the pressure in the heat exchanger and ozonized air is blown out the cooling system discharge. In all cases dielectric failure requires that the unit be shut down, the failed dielectric removed from service, and, in the event of ground plane puncture, the unit be taken out of service and repaired.

In an attempt to prevent ground plane puncture and need to disassemble an ozonator to remove a failed dielectric from service, the applicant's assignee Welsbach developed a fuse in 1965. This fuse was manufactured from 1965 to 1980 and used in air and oxygen service and consisted of a meltable fuse link connected between two terminals which were supported relative to one another by a standoff insulator of some sort, such as a ceramic rod. However, there were several majors problems with the original Welsbach fuse that the present invention corrects.

The fuse element was a standard ¾ ampere buss fuse wire and was subject to deterioration in the ozone atmosphere and subsequent failure.

At low voltages, 6 to 8 KV, the fuse did not always blow when a dielectric failure occured and consequently ground plane punctures occured.

When a dielectric failure occurs in large ozonators at any voltage the energy dump through the fuse causes rapid oxidation to the point of vaporization of the fuse and plating of the fuse metals onto the insulator supporting the fuse terminals. This plating in many cases allowed sufficient current to flow through the fuse to puncture the ground plane at the point of dielectric failure without interrupting the oxonator circuit breaker until after the damage was done.

THE PRESENT INVENTION

The present invention relates to a fuse structure for use with ozonators in corrosive atmosphere applications. The fuse itself is a fine ozone corrosion resistant fuse wire. The fuse wire is conductively attached to conductive terminal means, which, in turn, enable fuse connection into circuit. Rigid insulator spacing means engage and support the terminal means and space the terminal means so that the fuse wire is extended and so that the structure constitutes a unitary structure which may be handled as a unit. Very small diameter insulator tubing, preferably of glass, is placed over the fine wire over a substantial portion of its length and serves to shield the insulator spacing means from vaporized filament material which might otherwise provide a conductive path preventing opening of the circuit protected by the fuse.

There are two basic forms to the fuse. First, there is the air service fuse which is simplier but not intended for use in an oxygen atmosphere. In such an application, an oxygen service fuse is provided. The difference principally is that the oxygen service fuse is within a closed tubular housing, the tubular insulator walls of which provide the rigid insulator spacing means. Both of the alternative constructions embody the invention and both provide the advantages of the invention.

For a better understanding, reference is made to the accompanying drawings in which.

Figures 1, 2, 3, 4, 5, 6:
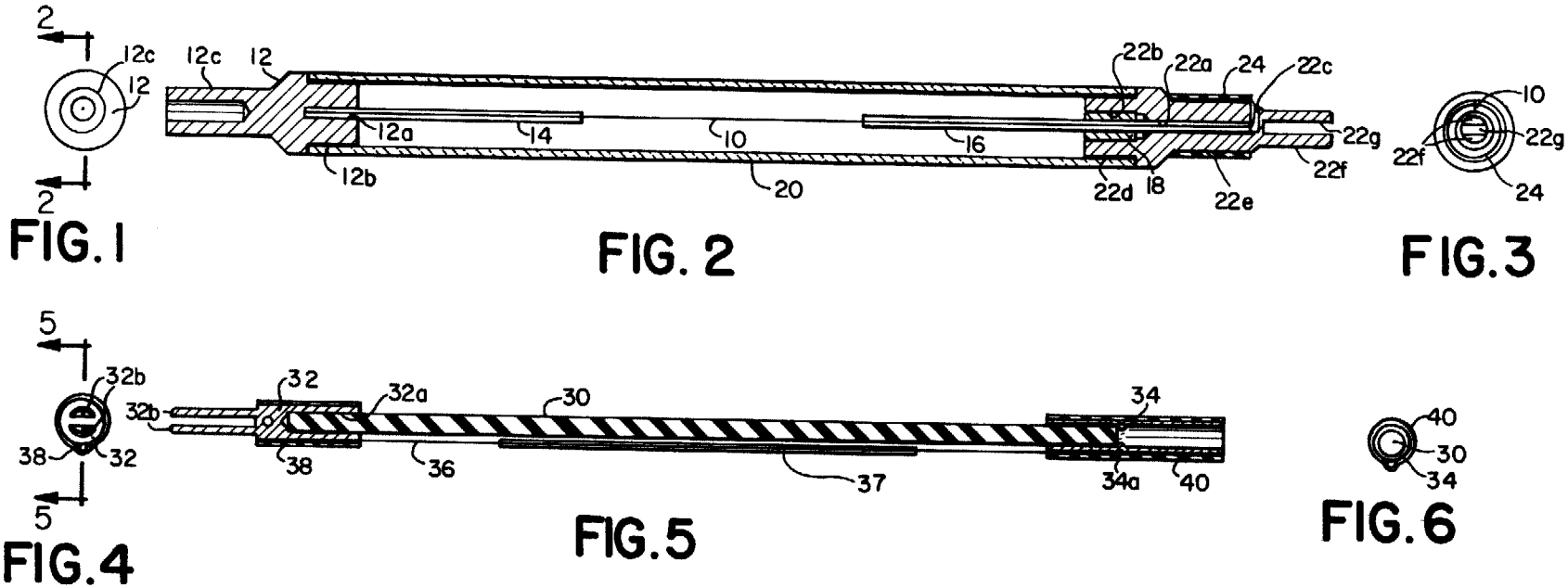
FIG. 1 is an end view of the oxygen service fuse.
FIG. 2 is a sectional view taken along line 2—2 of FIG. 1.
FIG. 3 is an end view from the opposite end of the fuse of FIGS. 1 and 2.
FIG. 4 is an end view of the air service fuse.
FIG. 5 is a sectional view taken along line 5—5 of FIG. 4.
FIG. 6 is an end view of the fuse of FIGS. 4 and 5.

Referring first to FIGS. 1 through 3, the oxygen service fuse assembly is shown. This fuse consists of a fuse wire 10, not necessarily circular in section, of stainless steel, nickel chrome, 25 aluminum or other corrosion, and particularly ozone corrosion, resistant alloys. At least 25 alloys were found suitable for the fuse wire 10 in varying degree depending upon their resistance to ozone corrosion in particular. The wire diameter is sized for current carrying capacity of the dielectric involved in the ozone generator, plus a factor of safety.

Terminal 12 has an axial counterbore 12a which receives the small diameter glass tube 14, which is sufficiently large, however, to encase the filament 10. The counterbore **12*a* is preferably designed to snugly engage shield tube 14 which is cemented in position with conductive cement. The filament 10 is first pulled through tube 14, bent back over the outer diameter thereof and fixed into the axial bore 12*a*** with conductive epoxy so that the filament makes good electrical contact with the terminal.

The outer diameter of terminal 12 corresponds at its maximum to the glass envelope. A portion of this diameter at the counterbored end is reduced by the thickness of the tubular glass envelope, in a portion **12*b* terminated at a distinct radial planar shoulder. The remote end portion is also a reduced diameter portion 12*c* beyond a tapered shoulder and preferably is provided with a cylindrical axial counterbore 12*d* of larger diameter than bore 12*a*. The filament 10** is soldered, welded or cemented in place, for example, with a conductive epoxy cement.

The filament wire is left uncut, and another tubular glass shield tube 16 similar to tube 14 is slid over the filament 10 and cemented to tubular metal sleeve 18. Cylindrical tubular glass envelope 20, selected to be snugly accommodated around the smaller diameter 12b of terminal 12 and rest against the shoulder is put in place and may be cemented in place with epoxy cement, for example. The filament wire 10 is then fed through axial bore **22*a* in terminal member 22 and out laterally through radial bore 22*c*. Axial bore 22*a* has a counterbore partway into terminal 22 such that sleeve 18 is snugly accommodated within the counter bore 22 and is preferably cemented into counterbore 22*b*. Smaller diameter portion 22*d* of terminal 22 has cement applied, and, as the filament is pulled through terminal 22, is seated inside the glass insulator envelope 20. Filament 10 is pulled so that slack is removed and welded, soldered or conductively cemented preferably to a flat on the sidewall 22*e* of the terminal 22. The cylindrical end of terminal 22 is bifurcated to provide brush engaging terminals 22*f* having a diametrical slot 22*g*. Once the structure is in place, a shrink tube 24 of insulator material is fitted over the portion 22*e* of the terminal and heated to shrink it into conformance with the surface of the terminal part 22*e*** it surrounds.

The filament shield tubes 14 and 16 are preferably tubular glass members having internal diameters large enough to accommodate the filament. Whether tubular or not, their function is to prevent vaporized fuse metal from fuse wire 10 from depositing on the interior wall of glass envelope tube 20, at least over such a length as to provide an alternative conductive path, even one with small enough gaps to permit arcing. During normal operation of the filament any particulate matter which may come off parts of the filament within the shield tubes 14 and 16 is stopped by the tubes. Then, upon failure of the filament, the shield tubes are of such nature that even though they probably fail and shatter themselves, they withstand the heat long enough to prevent vaporized material from reaching the walls of the tube. When a dielectric fails in an ozonator at low voltage and low current, the fuse wire 10 disintegrates and drops away usually without breaking the shield tubes. Thus, while a conductive path may be maintained within the inside of the shield tubes, the conductive path between the tubes has been broken. When the fuse wire fails at medium to high current at any voltage, the shield tubes disintegrate with the fuse wire, but the sequence is such as to protect the walls of tube 20 opposite the shielded portion of the filament 10 from any of the material which might deposit or plate out on tube 20 were not the shield tubes 14 and 16 present. The material of the shield tubes 14 and 16 may be varied, but the properties of the materials should be such that they are non-conductive and capable of withstanding failure condition long enough to provide shielding of the internal walls. It will be observed that the exposed wire portion between the tubular members 14 and 16 may or may not plate out on the internal walls of glass tube 20. If the filament covers 14 and 16 disintegrate in the failure, they fall harmlessly and do not cause a short circuit problem as the plating would, and the plating is confined to a short distance along glass envelope 20 with gaps too large for corona to occur.

The structure of FIGS. 1 through 3 is appropriate for an oxygen atmosphere because by containing the fuse wire within the housing, the structure of the fuse wire consumes only the oxygen within the housing assembly and does not permit an arc to occur which might be the result if the filament were exposed to pure oxygen or even a high concentration of oxygen or ozone. If an arc were to be established, it might come in contact with stainless steel or other sharp metallic surfaces, which in an oxygen atmosphere under high voltage conditions might support combustion.

On the other hand, the discontinuity between the shield tubes 14 and 16 permit some of the wire to vaporize and plate out on the interior walls of glass tube housing 20 so that the failure of the fuse can be easily visually detected.

Referring now to FIGS. 4, 5, and 6, a fuse is shown for use in normal air environments and under conditions where establishment of an arc is not likely. The structure is fundamentally the same but less expensive since the terminal elements are smaller, the tubular glass housing need not be provided, and the structure is much less complicated to make. In this instance, the rigid insulator spacing means is provided by a ceramic rod 30 which supports at opposite ends terminals 32 and 34. Terminal 32 is generally cylindrical with an axial bore which snugly receives the end of rod 30 and may be affixed thereto by suitable cements, if desired. The end of the terminal pieces are provided with brush engaging prong members 32 for easy circuit connection.

Terminal 34 may be a simple tubular member, preferably having a circumferential inwardly projecting ridge **34*a* formed in the tubular wall to act as a limit or stop to ceramic rod 30. Ceramic rod 30 is snugly received within the tubular terminal 34 and may be adhesively secured thereto, if desired. The filament wire is much more easily handled in this situation but is still composed of the same kinds of corrosion resistant materials. Preferably, a tubular glass shield sleeve 37 is placed over the filament wire, and it corresponds in type of material and function to the tubular shields 14 and 16 in FIG. 2. Again, positioning is not as critical and the shield 37 may be left free to slide on the rod provided that it is long enough to ensure a space sufficiently long opposite the ceramic rod on which filament material will not plate so that any possiblity of a breakdown of filament material plated on the ceramic is eliminated. The filament is affixed to the terminals, preferably along flats on the faces thereof by any suitable means, including welding, soldering, or conductive cement, such as epoxy. Once the joint is completed, it is protected by covering it with a suitable heat shrinkable tubular cover 38 for terminal 32 and a similar cover 40 for terminal 34**.

The functioning of the device of FIGS. 4–6 is similar to that of FIGS. 1–3. The tubular shield 37 will withstand all but complete failure of the filament 36 and even if the filament vaporizes, it will not permit plating into rod 30, even though it may break up as the result of the failure. Failure is detectable quickly by the plating of the filament material on parts of rod 30 not opposite shield 37, particularly if rod color is white to contrast properly.

Various embodiments of the present invention have been described. Additional embodiments will occur to those skilled in the art. All such variations and modifications within the scope of the claims are intended to be within the scope and spirit of the present invention.

I claim:

1. A fuse structure for use with ozonators and corrosive atmosphere applications comprising:

a fine ozone corrosion resistant fuse wire;

conductive terminal means to which the fuse wire is conductively attached and which in turn enable fuse connection into a circuit;

rigid insulator spacing means engaging and spacing the terminal means so that the fuse wire is extended and so that the structure constitutes a unitary structure which may be handled as a unit; and insulator shield means placed over the fuse wire over a substantial portion of its length and serving to shield the insulator spacing means from vaporized filament material when the fuse opens in order to avoid a conductive path being formed by vaporized fuse metal condensing on the insulator through which an alternate electrical path exists through the fuse.

2. The fuse structure of claim 1 in which the insulator shield means placed over the fuse wire consists of glass tubing.

3. The fuse structure of claim 1 in which there is more than one shield means with spacing between them to permit plating of a vaporized fuse onto the insulator spacing means when the fuse fails to permit easy detection.

4. The fuse structure of claims 1 or 2 in which the rigid insulator spacing means is a rod and the conductive terminals are end caps which fit over the rod at opposite ends thereof and the fuse wire extends between the terminal end caps generally parallel to the rigid insulator spacing means.

5. The fuse structure of claim 4 in which the rod constituting the rigid insulator spacing means is ceramic and of contrasting color to the fuse metal.

6. The fuse structure of claim 5 in which a single insulator shield means is employed.

7. The fuse structure of claim 4 in which covers are provided over the terminal means at least in the areas of connection to the fuse wire and are covered by tubular cover means of heat shrunk plastic to protect the joints between the terminals and the fuse wire.

8. The fuse structure of claims 1, 2 or 3 in which the filament is enclosed in a envelope in order to shield it from an oxygen or other arc supporting atmosphere in which it must be used.

9. The fuse structure of claim 8 in which the envelope is supplied by a tubular insulator which surrounds and engages portions of the conductive terminals at its opposite ends.

10. The fuse structure of claim 9 in which the filament is located generally axially within the cylindrical envelope and the envelope is made of transparent material.

11. The fuse structure of claim 10 in which two insulator shield means are employed and fixed to the respective terminals so that a central area between the shield means is subject to plating onto the cylindrical envelope upon failure of the fuse.

12. The fuse structure of claim 11 in which the terminal end of the fuse is brought out through a wall of one of the terminals and affixed to the outside wall thereof and a resinous tubular cover is shrunk over the terminal region in the area where the joint is made.

* * * * *